United States Patent [19]

Weaver et al.

[11] 4,012,729

[45] Mar. 15, 1977

[54] MULTI-ELEMENT IONIZATION CHAMBER

[75] Inventors: Stephen Weaver, Lakewood; Lyman L. Blackwell, Boulder; Paul A. Staby, Denver, all of Colo.

[73] Assignee: Statitrol Corporation, Lakewood, Colo.

[22] Filed: June 19, 1975

[21] Appl. No.: 588,153

[52] U.S. Cl. ..... 340/237 S; 250/381; 313/54

[51] Int. Cl.[2] ..... G08B 17/10

[58] Field of Search ..... 340/237 S; 250/381, 250/382, 384, 385, 388, 389; 313/54

[56] References Cited

UNITED STATES PATENTS

| | | | |
|---|---|---|---|
| 2,436,084 | 2/1948 | Weller | 250/385 |
| 2,585,649 | 2/1952 | Hanson | 250/385 |
| 2,981,840 | 4/1961 | Nahmias | 340/237 S |
| 3,295,121 | 12/1966 | Meyer | 340/237 S |
| 3,935,492 | 1/1976 | Sasaki et al. | 340/237 S X |

FOREIGN PATENTS OR APPLICATIONS

| | | | |
|---|---|---|---|
| 1,299,234 | 12/1972 | United Kingdom | 250/385 |

*Primary Examiner*—John W. Caldwell
*Assistant Examiner*—Daniel Myer
*Attorney, Agent, or Firm*—Max L. Wymore

[57] ABSTRACT

A fire alarm system utilizes an ionization type aerosol detector having first and second intercommunicating and electrically in series ionization regions or chambers irradiated by a particle source. Electrodes are provided which operate in conjunction with a DC voltage source to establish a relatively large voltage gradient across the first region and a relatively small voltage gradient in the second region. Also, the location of the ion source and the effective volumes of the regions are arranged to establish a comparatively high ion density in the first region. In operation, the impedance or resistance of the first region to ion current flow is substantially uninfluenced by the presence of combustion or smoke aerosols due to the relatively high field gradient while the impedance or resistance of the second region is measurably changed thereby. The insensitivity of the first region to the presence of smoke is due to the high voltage gradient therein, as well as to the high ion density therein. The detector operates by the method of employing the second region as a signal or sensing ion chamber and the first region as a reference chamber, thereby to develop electrical signals on the electrodes representative of detected smoke aerosols for driving the associated fire alarm circuitry. The ion collecting electrode in the second region defines a sensing volume which communicates with the surrounding atmosphere to be monitored and which is located at the optimum distance from the particle source to maximize ion production and collection.

16 Claims, 11 Drawing Figures

MULTI-ELEMENT IONIZATION CHAMBER

BACKGROUND OF THE INVENTION

The present invention relates to the detection of aerosols, such as smoke and other combustion aerosols, and more particularly to an improved device and method for detecting such aerosols.

Aerosol detection devices are commonly employed in fire alarm systems to energize alarms therein upon the detection of smoke in the surrounding atmosphere. As a consequence, these devices are frequently referred to as smoke detectors.

Heretofore, smoke detectors have been devised which utilize ionization effects to generate electrical signals to trigger fire alarms. Generally, these devices detect changes in ion current caused by the presence of smoke in the atmosphere being monitored and operate on the hereinafter described principle. The level of an ion current flowing between electrodes of an ion chamber under clean or clear air conditions will decrease upon the introduction of smoke into the region between the electrodes due to capture of ions by the relatively massive and slow moving aerosol particles making up the smoke. Typically, the mass of each aerosol particle is several thousand times larger than the mass of the ions they capture, while the velocities of the aerosol particles are negligible in comparison to the ion current velocity.

Thus, the velocities of the ions once captured by the aerosol particles are reduced substantially to a standstill relative to the ion current, and hence in essence are removed therefrom. The actual drop in ion current is determined by and directly proportional to the number of such ion captures taking place per unit of time.

Prior art smoke detectors of the type utilizing a single ion chamber, i.e., having a single region of ionization, have been constructed. These devices are generally subject to one or more of the below described drawbacks. In order to generate a usable and measurable output signal representative of changes in ion current, a high value resistor, such as $10^{11}$ ohms, commonly was used in conjunction with the ion chamber to form therewith a voltage divider. Many problems are encountered with the use of such high value resistors including stability, handling, high cost, and problems caused by environmental conditions like temperature and humidity. Further, such a single ion chamber has the inherent disadvantage of having no intrinsic temperature, pressure or humidity compensation ability. Certain types of circuitry may be designed to minimize these atmospheric effects on a single ion chamber, however, there is then the added cost of such circuitry.

Prior art smoke detectors of the dual chamber type, also have been devised.

In such devices, two ion chambers are provided with an ion source for each. One of the ion chambers is a reference chamber which must be isolated from smoke in the surrounding atmosphere, while the other chamber is employed as a sensing chamber to sense the smoke in the surrounding atmosphere. A first disadvantage of this type of smoke detector is that two ion sources must be provided. These ion sources which are generally radioactive isotopes, such as alpha particle emitters, are costly. Secondly, in order for such smoke detectors to operate properly under varying temperature, pressure and humidity conditions, their two ion sources must be matched and both ion chambers must be subject to atmospheric changes. The latter requirement poses a design problem in the construction of the reference chamber since smoke must be prevented from entering this chamber, while other atmospheric changes must be allowed to influence it. Further, one of the chambers should be electrically isolated from the remainder of the smoke detector circuitry. This fact limits the physical design of the smoke detector.

Patents of general interest known to applicant are listed below.

| Country | Patent no. |
|---|---|
| U.S.A. | 2,397,075 |
| U.S.A. | 2,440,167 |
| U.S.A. | 2,736,816 |
| U.S.A. | 2,874,304 |
| U.S.A. | 3,018,376 |
| U.S.A. | 3,162,846 |
| U.S.A. | 3,353,170 |
| U.S.A. | 3,500,368 |
| U.S.A. | 3,514,603 |
| U.S.A. | 3,521,263 |
| U.S.A. | 3,560,737 |
| U.S.A. | 3,676,678 |
| U.S.A. | 3,693,009 |
| U.S.A. | 3,710,365 |
| West Germany | 1,062,957 |

Of particular interest, as illustrative of a variant of the earlier described prior art devices, is the above-listed U.S. Pat. No. 3,693,009 to Sasaki. The ionization smoke detecting device disclosed therein has a single ionization chamber defined between a pair of electrodes with a grid electrode positioned therebetween. A radioactive source is positioned adjacent to one of the outer electrodes of the ion chamber and a linear voltage gradient is established between the outer electrodes under a smoke free condition.

Upon entry of smoke into the ion chamber, the voltage gradient between the outer electrodes becomes non-linear and the grid electrode, which acts as a voltage probe, is appropriately positioned to sense the greatest change of shift in this voltage gradient. As will become apparent from the description of the present invention hereinafter, the Sasaki device and its operation, while of interest as illustrative of the state of the prior art, is distinguishable and embodies a quite different concept from that of the present invention.

SUMMARY OF THE INVENTION

It is, accordingly, an object of the present invention to provide an improved device and method for detecting aerosols, such as smoke and other combustion aerosols.

It is further an object of the present invention to provide an improved aerosol detection device and method as set forth characterized by utilizing two regions of ionization, one of which is formed to be highly sensitive to the entry of selected aerosols therein to function as a sensing ion chamber, and the other of which functions as a reference ion chamber by being formed to be substantially insensitive to the entry of such aerosols.

It is additionally an object of the present invention to provide an improved aerosol detection device and method as set forth characterized by requiring only a single ion source.

It is also an object of the present invention to provide an improved aerosol detection device and method as set forth characterized by being operable to minimize the effects of environmental conditions, other than those selected to be sensed.

It is another object of the present invention to provide an improved aerosol detection device and method utilizing two regions of ionization, one region of which functions as a sensing ion chamber and the other of which functions as a reference ion chamber, characterized by having a comparatively large voltage gradient established across the reference region of ionization to minimize its sensitivity to the presence of aerosol particles.

It is yet another object of the present invention to provide an improved aerosol detection device and method utilizing two regions of ionization, one region of which functions as a reference ion chamber, characterized by having a comparatively higher effective ion density established in the reference region to minimize its sensitivity to the presence of aerosol particles.

It is also an object of the present invention to provide an improved aerosol detection device and method utilizing two regions of ionization, one of which functions as a sensing ion chamber and the other of which functions as a reference ion chamber, characterized by having a sensing volume defined in the sensing ion chamber in relatively free communication with the surrounding atmosphere to be monitored and located an optimum distance from the particle source irradiating the sensing ion chamber to enhance ion collection therein.

It is still another object of the present invention to provide an improved fire or combustion alarm system characterized by utilizing an improved aerosol detection device of the type hereinabove set forth.

In accomplishing these and other objects, there is provided in accordance with the present invention a fire alarm system utilizing an ionization type aerosol detector. The aerosol detector defines first and second intercommunicating ionization regions, or chambers, which are electrically in series. A single particle source is positioned to produce ions in both of the regions. Electrodes are provided which operate in conjunction with a DC voltage source to establish a relatively large voltage gradient across the first region and a relatively small voltage gradient in the second region. Also, the location of the particle source and the effective volumes of the regions are arranged to establish in the first region an ion density which is comparatively higher than that established in the second region. In operation, the impedance or resistance characteristic of the first region to ion current flow between its associated electrodes is substantially uninfluenced by the presence or absence of combustion aerosols, like smoke, therein, so as to be suitable for use as a reference ion chamber, while the impedance or resistance of the second region to ion current flow between its associated electrodes is measurably changed as the result of the entry of smoke therein. Thus, the second region may be used as a signal or sensing ion chamber and the electrical signals generated on the electrodes as a result of smoke entry into the detector may be used to drive the associated fire alarm circuitry. The insensitivity of the first region to the presence or absence of smoke aerosols is due to the high voltage gradient therein. The ion collecting electrode in the second region preferably defines a sensing volume located at an optimum distance from the particle source to enhance ion collection.

Additional objects of the present invention reside in the specific construction of the exemplary ionization type aerosol detector hereinafter particularly described in the specification, and shown in the several drawings, as well as in its method of operation.

DETAILED DESCRIPTION OF THE PREFERRED EMBODIMENT

Figure 1:
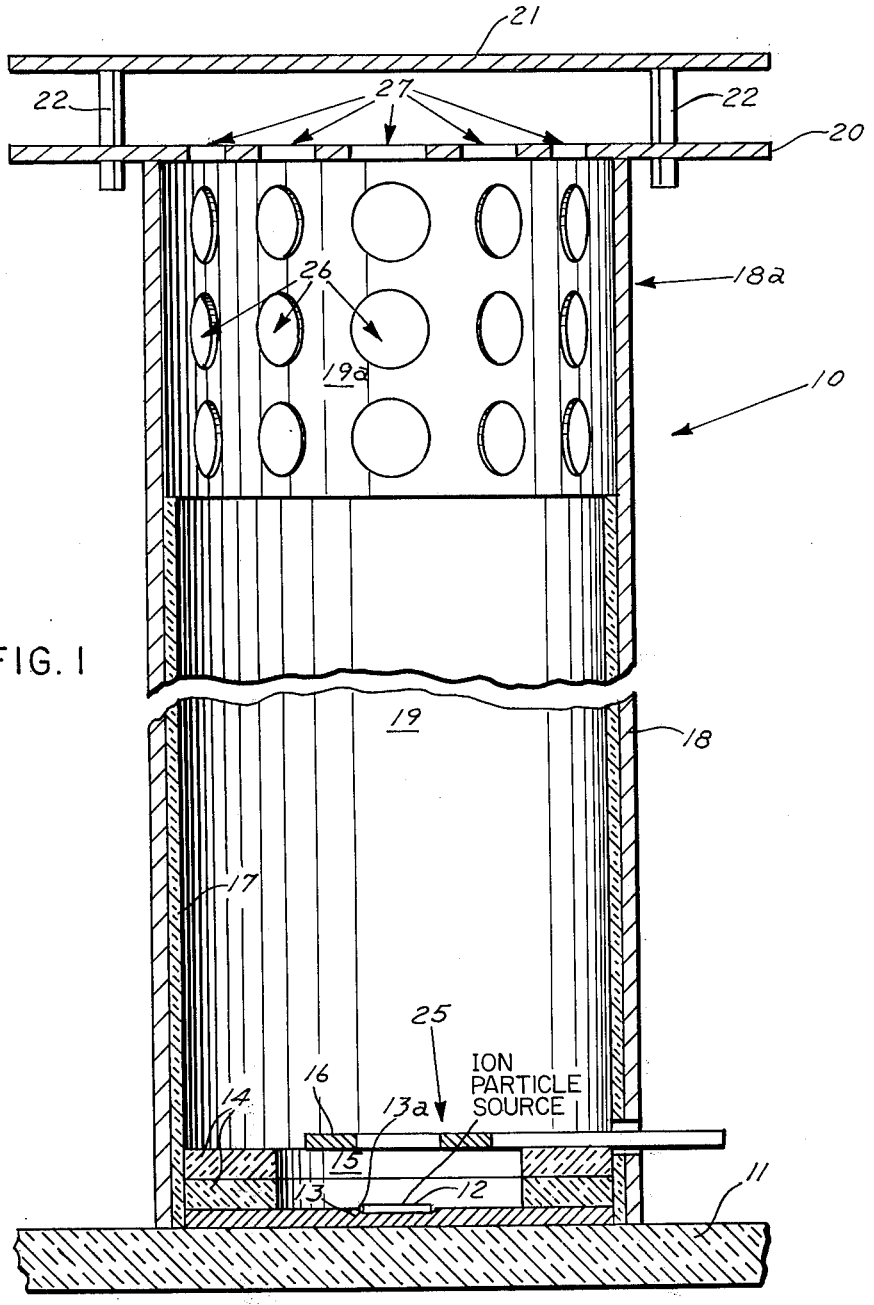
FIG. 1 is a cross-sectional elevation view of a cylindrically shaped ionization type aerosol detector according to the present invention, suitable for detecting smoke and other combustion products.

Referring to the drawings in more detail, there is shown in FIG. 1 an ionization type aerosol or smoke detector generally identified by the numeral 10.

The detector 10 is made up of the following components: a circuit board 11 made of an electrical insulating material; an ion source 12, which is preferably an alpha particle source; an electrically conductive element 13 which functions both as a holder for the particle source 12 and as an electrode; insulating washers or rings 14 which define a first ionization region or chamber 15; an electrically conductive element or ring 16 which functions as an electrode; an inner cylindrical sleeve 17 made of an electrical insulating material; a cylinder 18 made of an electrically conductive material, the cylinder 18 being positioned around the sleeve 17 and defining in conjunction with the sleeve 17 a second ionization region or chamber 19; and electrically interconnected electrostatic shields 20, 21 mounted in a parallel, spaced apart and aligned disposition by support structure 22. The structure 22 may be formed as tab portions on the shield 21 bent to form the interconnecting brace structure.

As shown in FIG. 1, the cylindrical electrode 18 is mounted on the planar circuit board 11 to extend perpendicularly therefrom. The insulating sleeve 17, which is a selected distance shorter in length than the electrode 18, is positioned within the electrode 18 with one end in contact with the circuit board 11. Positioned on the circuit board 11, within the sleeve 17, is the electrode 13. The electrode 13 is in the shape of a disc and preferably has a slight depression 13A formed centrally therein for receiving the particle source 12. The particle source 12 is shown mounted in the depression 13A in a substantially parallel disposition with respect to the plane of the electrode 13.

The insulating rings 14 fit with the sleeve 17 and are positioned on the electrode 13 to define around the particle source 12 the ionization region 15. The region 15 is cylindrical in shape and has its axis concentric with that of the electrode 18, the sleeve 17 and the axis of radiation of the ion source 12.

The ring electrode 16 is positioned against the outwardly positioned insulating washer 14 in a substantially parallel disposition with respect to the electrode 13. The electrode 16 further is disposed centrally within the sleeve 17 with its center axis concentric with the center axis of the cylindrical electrode 18. The ring electrode 16 defines an aperture 25 through which particles emitted by the particle source 12 are introduced into the ionization region 19.

The portion 18A of the cylindrical electrode 18 extending beyond the insulating sleeve 17 has smoke entry holes 26 formed therein. Further, the electrostatic shield 20 positioned across the end of the cylindrical electrode 18 has smoke entry holes 27 formed therein. The electrode portion 18A in conjunction with the shield 20 defines a perforated cup which functions to permit the entry of smoke in the surrounding atmosphere into the detector 10.

The shields 20, 21 illustrated are in the form of cylindrical discs and are positioned substantially perpendicular to the center axis of the detector 10. The center axis of the detector 10 is defined by the longitudinal axis of the cylindrical electrode 18. The outer shield 21 has no smoke entry holes formed therein and the shields 20, 21 together function to prevent static charges in the surrounding atomsphere from disrupting ion currents in the detector 10.

Figure 2:
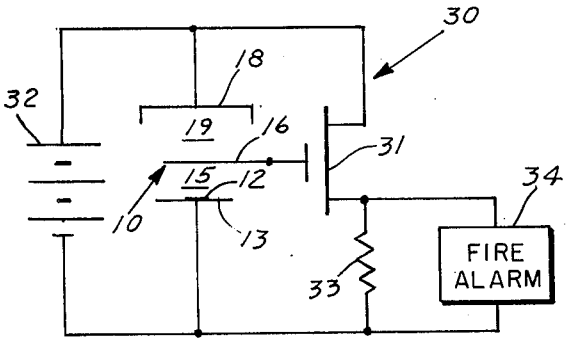
FIG. 2 is a circuit diagram of a fire alarm system having the detector of FIG. 1 incorporated therein.

The smoke detector 10 is shown in FIG. 2 incorporated in a fire alarm system generally identified by the numeral 30. The system 30, in addition to the detector 10, includes a field effect transistor (FET) 31, a DC voltage source 32, a load resistor 33 and a fire alarm 34.

The voltage source 32 may, for example, supply 10 volts DC, and will be assumed to be a 10 volt DC source in the discussion hereinafter. As shown in FIG. 2, the negative terminal of the voltage source 32 is connected to the detector electrode 13, while its positive terminal is connected to the detector electrode 18. The detector ring electrode 16 is connected to the gate electrode of the FET 31. The drain-source current path of the FET 31 is connected in series with the load resistor 33 across the voltage source 32, with one terminal of the resistor 33 being connected in common with the negative terminal of the voltage source 32. The fire alarm device 34 is connected across and in parallel with the load resistor 33 to be actuated by the voltage signal generated thereon.

Figure 4:
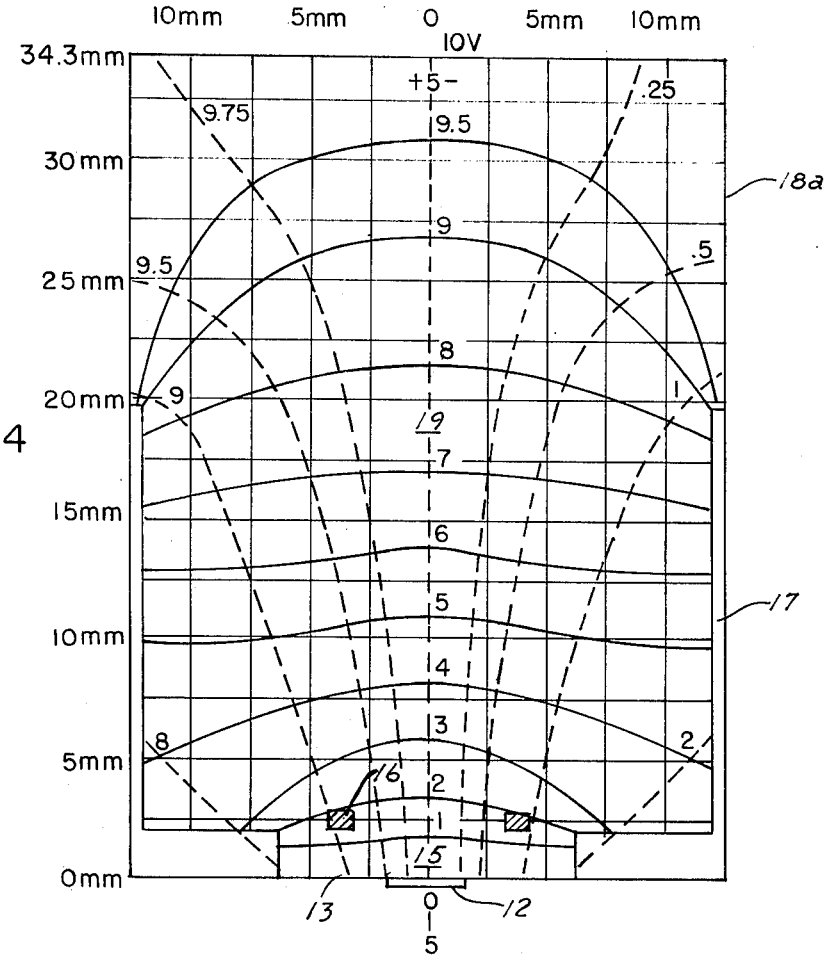
FIG. 4 is an equipotential line plot and electric field plot of the detector of FIG. 1.
Figure 7:
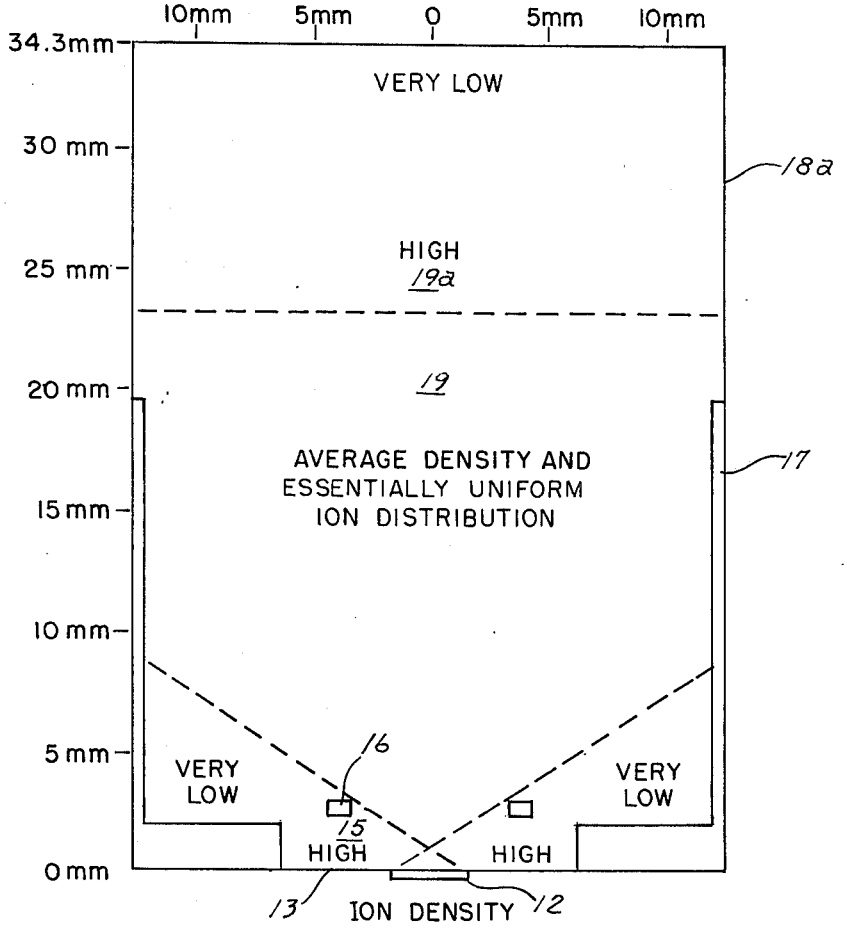
FIG. 7 illustrates the typical ion distribution or density at any given instant of time within the detector of FIG. 1.

Indicated on FIGS. 4 and 7 are the dimensions of an exemplary smoke detector 10 constructed in accordance with the present invention. The detector 10 constructed had a length along its center axis of approximately 34.3 millimeters and a radius of about 12.5 millimeters. As there shown, the portion 18A of the electrode 18 defines a cylindrical sensing volume 19A of approximately 15 millimeters in length.

In FIG. 4, an equipotential line polt is there shown in solid lines for the exemplary detector 10 with 10 volts DC applied across its electrodes 13 and 18. The electric field line plot is also shown in FIG. 4 in dashed lines.

Figure 5B:
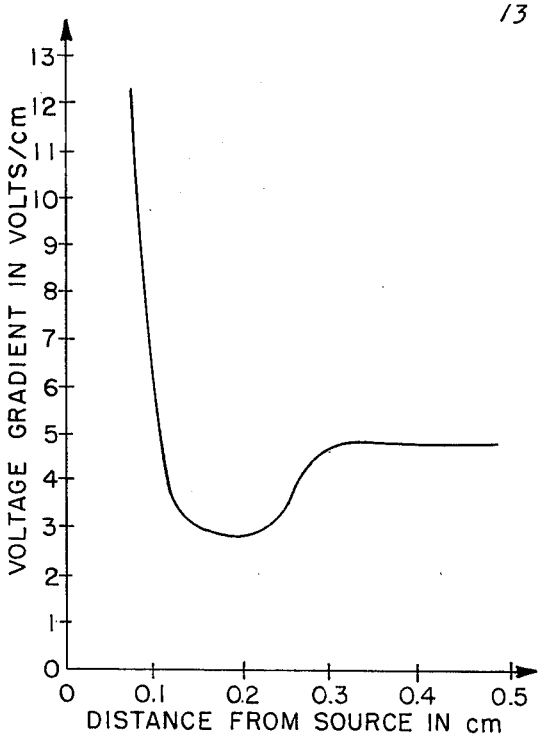
FIGS. 5A and 5B are voltage and voltage gradient plots, respectively, for the space within the dectector of FIG. 1 in close proximity to its particle source.
Figure 5A:
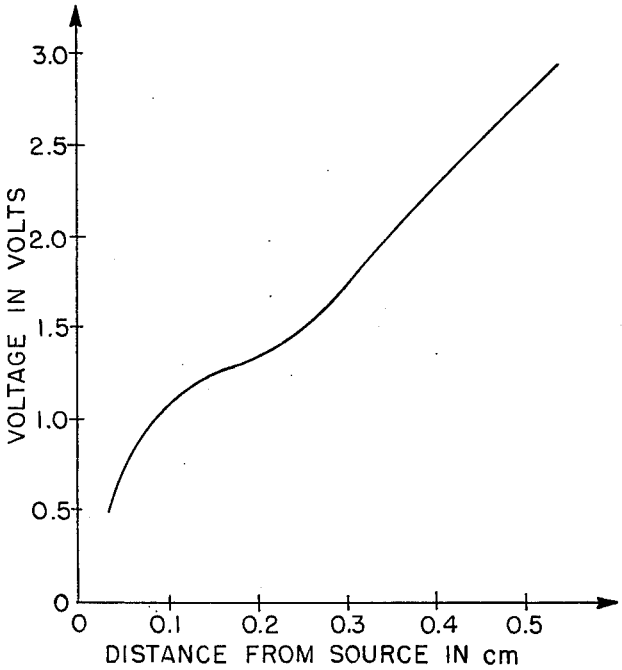
Figure 5:
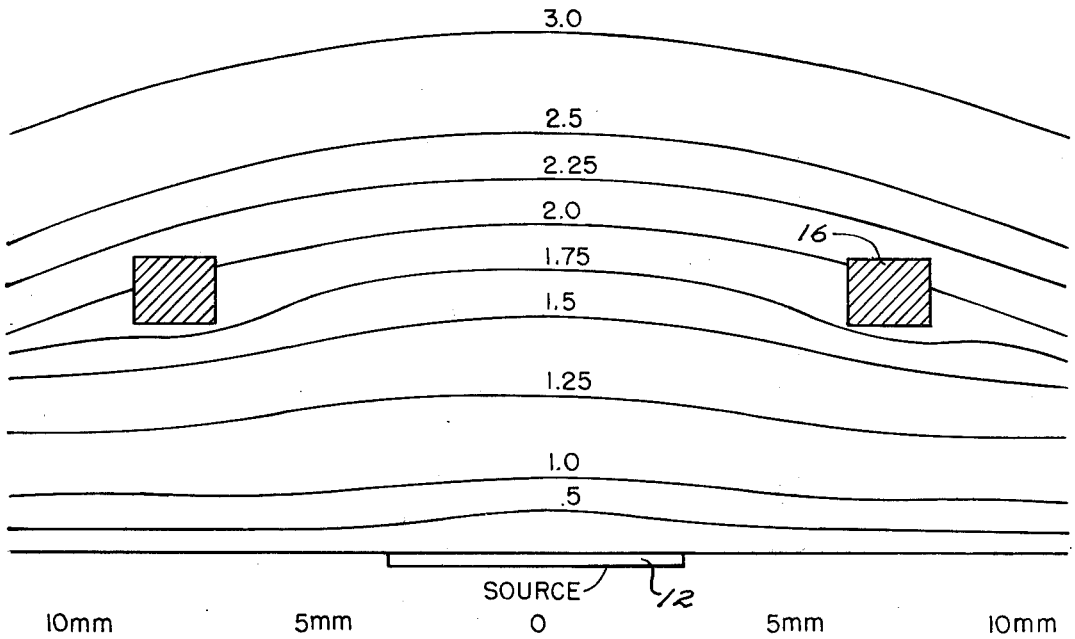
FIG. 5 is an equipotential plot for the space within the detector of FIG. 1 in close proximity to its particle source.
Figure 8:
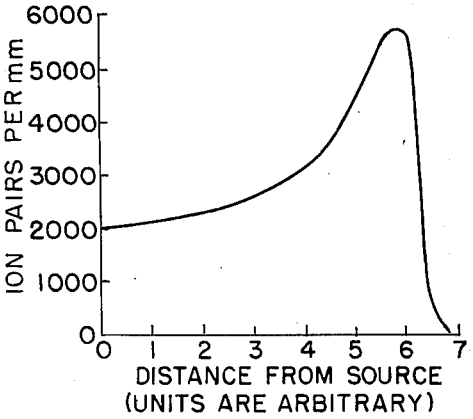
FIG. 8 is a generalized plot of the ion pairs formed vs distance from source, known in the art as the Bragg curve.
Figure 9:
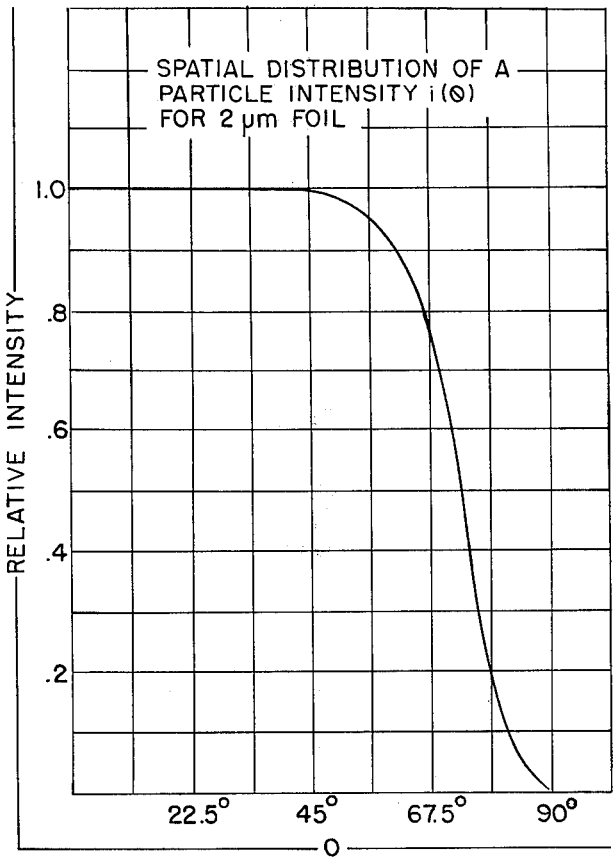
FIG. 9 is a plot of spatial distribution of particle intensity.

FIG. 5 is an equipotential line plot of the ionization region 15.

FIG. 4 is a plot of data generated by a device according to the invention and may be generally mathematically represented by the following equation:

$$V(r,\theta)=\frac{Q}{4\pi\epsilon_o}\left[\frac{1}{r}-\frac{1}{2}\ \frac{a^2}{r^3}\left(\frac{3}{2}\cos^2\theta-\frac{1}{2}\right)+\ldots\right]. \quad (1)$$

Where: $\gamma$ and $\theta$ define the point at which the potential is to be calculated $r$ being the radial distance along a vector extending from the centerpoint of the inner end of the electrode portion 18A to a point at which potential is to be calculated and $\theta$ being the angle between this vector and the longitudinal axis of the detector 10;

Q is the charge present on 18A;

$\epsilon_0$ is the permittivity of free space; and, $a$ is the inside radius of 18A.

FIG. 5 may be generated for the ionization region 15 by using the aforementioned equation (1). In this case the value of the charge Q used in the equation (1) will be that on detector ring electrode 16 and the quantity $a$ therein will be the radius of the detector ring electrode 16. The distance $r$ in this case is measured from the centerpoint of the electrode ring 16.

Figure 6A:
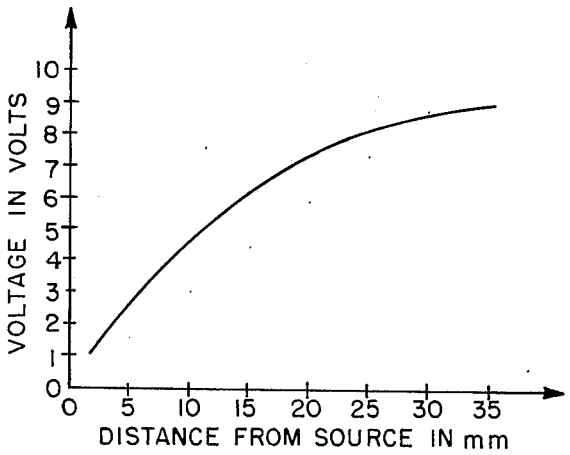
FIG. 6A and 6B are voltage and voltage gradient plots, respectively, for the remaining space within the detector of FIG. 1.
Figure 6B:
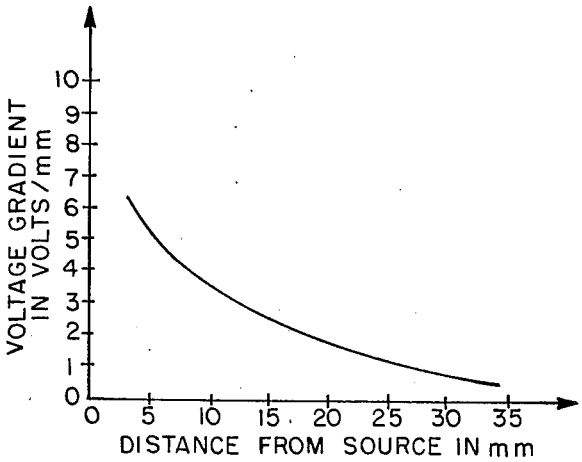

FIG. 6A is a plot of voltage as a function of distance in millimeters from the particle source 12 for the ionization region 19 and the sensing volume 19A within the detector 10. FIG. 6B is a plot of the voltage gradient in volts/millimeter.

FIG. 7 illustrates the relative ion densities within the regions 15, 19 and 19A of the detector 10. From FIG. 7, it is apparent that the average ion density in the reference chamber or region 15, is substantially higher than the average ion density in region 19. The ion densities in the portions of regions 15 and 19A marked HIGH in FIG. 7 are approximately the same, and about two to three times the ion density in the portion of region 19 marked UNIFORM. This is due to the close proximity of region 15 to the particle source 12, to the much smaller effective volume of the region 15, and due to the great reduction in energy and range of the alpha particles caused by traversing the gold cover foil at large angles. The relatively high field gradient and ion density in region 15 has been found to render the impedance or resistance of region 15 substantially insensitive and uninfluenced by the presence of smoke aerosols. Some insensitivity has been determined by experimentation by establishing a given ion current between the electrodes 13 and 16, and measuring changes therein caused by the presence of smoke. This is done by applying a fixed voltage across electrodes 13 and 16. Ion current changes under these test conditions have been found to be negligible. Thus, for purposes of detecting smoke and combustion aerosols, the reference region 15 functions as a fixed electrical resistance between the detector electrodes 13 and 16.

A comparison of FIGS. 5A, 5B and 6A, 6B, as well as an examination of FIG. 4, reveals that the voltage gradient in ionization region 15 is much higher than the voltage gradient in region 19, and in particular is much higher than the voltage gradient within the sensing region 19A defined by the electrode portion 18A. This fact is also believed to essentially render the region 15 insensitive to smoke and combustion aerosols. As apparent from FIG. 4, the nonlinear voltage gradient defined within the detector 10 is due to the geometry of the detector 10 and its components, and the location of its electrodes with relation to the position of the particle source 12.

In operation of the detector 10 and the fire alarm system 30 shown in FIG. 2, the ionization region 15 operates as a fixed resistance the magnitude of which is uninfluenced by smoke aerosols; while the region 19 operates as a variable resistance connected between electrodes 16 and 18, the magnitude of which increases due to the presence of smoke aerosols therein and in the sensing volume 19A.

Figure 3:
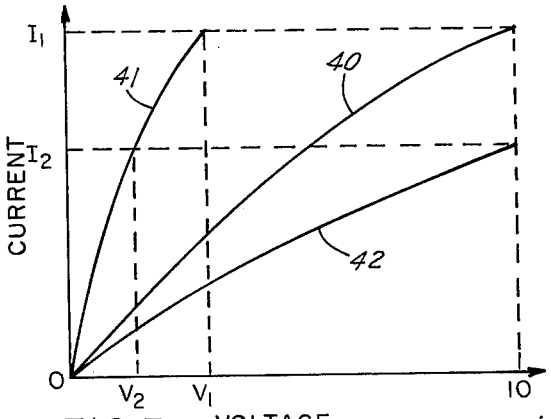
FIG. 3 is a characteristic curve relating the ion current of the detector of FIG. 1 to its electrode voltages.

Referring to FIG. 3, curve 40 is a plot under clear air conditions of ion current through the electrically in series ionization regions or chambers 15, 19 as a function of the DC voltage applied across the electrodes 13 and 18. With ten volts DC applied, the ion current in the detector 10 is $I_1$. Curve 41 is a plot of the voltage on the ring electrode 16 as a function of the ion current flowing in the detector 10. Thus, under clear air conditions with ten volts DC applied across the electrodes 13 and 18, the voltage $V_1$ is present on the ring electrode 16.

Curve 42 is a plot of ion current through the detector 10 upon entry of smoke into the sensing region of the detector 10. As shown in FIG. 3, the ion current 42 drops to $I_2$ upon the entry of smoke into the detector 10. This drop in ion current to $I_2$ causes the voltage on the ring electrode 16 to drop to $V_2$.

Referring to FIG. 2, the voltage drop on the electrode 16 caused by the entry of smoke into the detector 10, i.e. $V_1 - V_2$, appears on the gate electrode of the FET 31. As a consequence, the drain-source current of the FET 31 changes and causes the generation of a voltage signal on the load resistor 33 to actuate the conventional fire alarm device 34. Actuation of the alarm 34 thus indicates the entry of smoke aerosols into the detector 10.

It is noted that circuitry of the fire alarm system 30 is preferably incorporated in the printed circuit board 11 of the detector 10. Further, the FET 31 acts as a current amplifier in the system 30, being connected as a source follower.

It is also noted that in the construction of the detector 10, the presence of the insulating sleeve 17 functions to limit the collection of emitted ions by the electrode 18 to the sensing region 19A defined by the cylindrical electrode portion 18A. This sensing volume 19A is located a selected distance from the particle source 12 to enhance ion collection, thereby to render this sensing region more sensitive to smoke. The dimensions of the detector 10 indicated in FIG. 7 are particularly suited for use with an alpha particle source since the average range of emitted alpha particles which are introduced into region 19 is approximately 30 millimeters. Further air current within the sensing volume 19A tend to cause the ions to be collected by the electrode portion 18A, rather than being blown away. This minimizes problems due to air velocity and winds.

Presence of smoke entry holes only in the shield 20 give best air velocity results for the smoke detector 10. The holes 26 in the electrode portion 18A, however, increase sensitivity of the detector 10 to smoke aerosols. The sizes of the holes 26, 27 are such to permit easy penetration of smoke aerosols.

It is remarked that operation of the detector 10 is relatively uninfluenced by changes in atmospheric conditions, such as temperature, pressure and humidity changes which alter the range of emitted alpha particles, since the length and location of the sensing volume 19A defined by the electrode portion 18A may be arranged to maximize ion collection under all atmospheric conditions expected to be encountered.

It is additionally remarked that the size of the aperture 25 and of the outer diameter of the ring electrode 16 may be varied to establish ion density between the regions 15 and 19. Increasing the size of the aperture 25, for example, has the effect of increasing the number of ions entering the region 19, and thus of increasing the ion current and average density therein. A change in the size of the aperture 25 and the outer diameter of the ring electrode 16 also changes the angles at which alpha particles are emitted by the source 12 into the region 19. Inherently, the average range of the emitted alpha particles in region 19 is a function of these angles.

It is also noted that one of the reasons for the relatively high ion density in the region 15 is that the alpha particles emitted by the source 12 have relatively low energy, less than two million electron volts (MEV), and thus, are stopped in this region. This tends to maximize ion current in the region 15 which may increase its insensitivity to smoke aerosols. Thus, the outer and inner diameter of the collecting ring 16 may be varied to alter the smoke detector's temperature, pressure and humidity characteristics.

The insulating sleeve 17 employed in the detector 10 may be made of a Teflon material, since such has been found to have sufficient volume and surface resistivity under high humidity conditions. A Teflon material may also be used for the insulating rings 14 used to define the reference ion chamber or region 15. A suitable particle source is a planner shaped nuclear foil containing the radioactive element Americium, which is an alpha particle source. The nuclear foil is typically made of a layer of Americium and gold, covered over on the alpha emitting side with gold layers and on the non-emitting side with at least one layer of silver. The Nuclear Radiation Development Company, 2937 Alt Boulevard North, Grand Island, New York, produces a nuclear foil suitable for use as the ion source 12, which it identifies as its Model AMM. Alpha particle emission in approximately the 5.4 MEV range constitutes typically 99.6 percent of the radiation of such sources, while gamma radiation constitutes the balance. Virtually no beta radiation is emitted by these sources.

Although the invention has been shown herein and described in what is conceived to be the most practical and preferred embodiment, it is recognized that departures may be made therefrom within the scope of the invention. Although an alpha particle source is taught as being preferred, the use of beta and gamma sources may be made with reasonable success.

What is claimed is:

1. An aerosol detection device, comprising:

structure defining intercommunicating first and second substantially cylindrical ion chambers, each of said chambers having a longitudinal axis and first and second ends, the second end of said first ion chamber being in communication with the first end of said second ion chamber and the longitudinal axis of said ion chambers being substantially aligned to define a common axis, the effective volume of said first ion chamber being substantially smaller than the effective volume of said second ion chamber;

a first electrode having a center axis positioned at the first end of said first ion chamber, said first electrodes being in the shape of a disc and extending substantially perpendicularly to the common axis of said ion chambers with its center axis substantially aligned with said common axis;

a second electrode positioned within said ion chambers substantially at the intercommunication of the second end of said first ion chamber with the first end of said second ion chamber; said second electrode being in the form of a ring to define an aperture in its center and having a center axis, the center axis of said ring being substantially aligned with the common axis of said ion chambers;

a third electrode positioned at the second end of said second ion chamber;

particle source means for substantially simultaneously emitting charged particles into said first and second ion chambers, said particle source means being a single source and having an axis of radiation along which emitted charged particles are radiated, said single particle source being in said first ion chamber adjacent said first electrode with its axis of radiation substantially aligned with the common axis of said ion chambers whereby to introduce charged particles into said first ion chamber and therethrough through the aperture defined by said second electrode into said second ion chamber;

means for establishing a single ion current flow of said charged particles third electrodes serially through said ion chambers, said means being operable to establish under clear air conditions a first voltage gradient in said first ion chamber between said first and second electrodes and a second voltage gradient in said second ion chamber between said second and third electrodes, said first voltage gradient being substantially higher than said second voltage gradient to render the electrical resistance characteristic of said first ion chamber to said ion current flow therethrough relative to said second ion chamber substantially insensitive to the presence or absence of smoke aerosols and the like; and means for connecting said second ion chamber in communication with atmosphere to be monitored so that smoke aerosols and the like therein enter said second ion chamber, the electrical resistance characteristic, of said second ion chamber to said ion current flow, increasing as the result of the entry of smoke aerosols and the like therein whereby to cause a change in the voltage on said second electrodes indicative of the presence of smoke aerosols and the like in the atmosphere being monitored.

2. The invention defined in claim 1, wherein:

said single particle source is an alpha emitter;

said third electrode defines a substantially cylindrical sensing volume having a longitudinal axis substantially aligned with the common axis of said ion chambers; and the distance between said single particle source and said sensing volume is substantially equal to the average range of said alpha particle emitted by said single particle source.

3. The invention defined in claim 2, wherein said third electrode has holes therein which connect said second ion chamber in communication with the surrounding atomsphere.

4. The invention defined in claim 3, wherein said third electrode is in the shape of a cup having a cylindrical side wall and an end wall substantially perpendicular to its cylindrical side wall, said cup electrode having said holes in its side and end walls, and including means for shielding said sensing volume defined by said cup electrode from electrostatic charges in the atmosphere surrounding said third electrode and from air currents, said electrostatic - air current shielding means being formed as a pair of electrically interconnected, mutually parallel discs said shielding discs having their center axis substantially aligned with the common axis of said ion chambers, one of said shielding discs defining the end wall of said cup electrode.

5. The invention defined in claim 1, in combination with alarm means for generating an alarm signal indicative of the detection of smoke aerosols and the like, said alarm means being responsive to voltage changes on said second electrode.

6. An aerosol detection device, comprising:

structure defining intercommunicating first and second substantially cylindrical ion chambers, each of said ion chambers having a longitudinal axis and first and second ends, the second end of said first ion chamber being in communication with the first end of said ion chamber and the longitudinal axis of said ions chambers being substantially aligned to define a common axis a first electrode positioned at the first end of said first ion chamber;

a second electrode positioned within said ion chambers substantially at the intercommunication of the second end of said first ion chamber with the first end of said second ion chamber, said second electrode being in the form of a ring to define an aperture in its center and having a center axis, the center axis of said ring being substantially aligned with the common axis of said ion chambers;

a particle source having an axis of radiation along which emitted charged particles are radiated, said particle source being in said first ion chamber adjacent said first electrode with its axis of radiation substantially aligned with the common axis of said ion chambers whereby to introduce charged particles into said first ion chamber and therethrough through the aperture defined by said second electrode into said second ion chamber; and a third electrode positioned at the second end of said second ion chamber, said third electrode defining a substantially cylindrical sensing volume and having a longitudinal axis substantially aligned with the common axis of said ion chambers, said sensing volume being located a distance from said particle source substantially equal to the average range of the particles emitted therefrom, said third electrode having holes therein which connect said second ion chamber in communication with the surrounding atmosphere.

7. The invention defined in claim 6, wherein said third electrode is in the shape of a cup having a cylindrical side wall and an end wall substantially perpendicular to its cylindrical side wall, said cup electrode having said holes in its side and end walls.

8. The invention defined in claim 7, including means for shielding said sensing volume defined by said cup electrode from electrostatic charges in the atmosphere surrounding said third electrode and from air currents, said electrostatic - air current shielding means being formed as a pair of electrically interconnected, mutually parallel discs, said shielding discs having their center axes substantially aligned with the common axis of said ion chambers, one of said shielding discs defining the end wall of said cup electrode.

9. A method of detecting the presence of smoke aerosols and the like, comprising:

establishing a first region of ionization having a first voltage gradient therein;

establishing a second region of ionization having a second voltage gradient therein, said first voltage gradient being substantially higher than said second voltage gradient to render the resistance characteristic of said first region of ionization to ion current flow therethrough relative to said second region of ionization substantially insensitive to the presence or absence of smoke aerosols and the like;

establishing a single ion current flow which serially flows through said first and second regions of ionization, said ion current flow having a predetermined level under clean air conditions; and measuring changes in said ion current flow from said predetermined level which occur as a result of the entry of smoke aerosols and the like into said second region of ionization.

10. The method of claim 9, including establishing an ion density in said first region of ionization which is substantially higher than in said second region of ionization.

11. The method of claim 10, wherein said ion current flow is established by emitting charged particles from a single particle source into said first and second regions of ionization and including collecting said ion current flow in said second region of ionization in a sensing volume located a distance from the particle source corresponding to the average range of said emitted charged particles.

12. The method of claim 11, wherein said charged particles emitted by the particle source are alpha particles.

13. A method of detecting the presence of smoke aerosols and the like, comprising:

establishing a first region of ionization having a first ion density therein;

establishing a second region of ionization having a second ion density therein, said first ion density being substantially higher than said second ion density to render the resistance characteristic of said first region of ionization to ion current flow therethrough relative to said second region of ionization substantially insensitive to the presence or absence of smoke aerosols and the like;

establishing a single ion current flow which serially flows through said first and second regions of ionization, said ion current flow having a predetermined level under clear air conditions; and measuring changes in said ion current flow from its predetermined level which occur as a result of the entry of smoke aerosols and the like into said second region of ionization.

14. The method of claim 13, wherein said ion current flow is established by emitting charged particles from a single particle source into said first and second regions of ionization and including collecting said ion current flow in said second region of ionization in a sensing volume located a distance from the particle source corresponding to the average range of said emitted charged particles.

15. The method of claim 14, wherein said emitted charged particles emitted by the particle source are alpha particles.

16. An aerosol detection device, comprising:

means for defining intercommunicating first and second ion chambers;

means for substantially simultaneously emitting charged particles into said first and second ion chambers;

means for generating a single ion current flow serially through said ion chambers having a predetermined current level under clear air conditions;

means for generating a substantially higher voltage gradient and ion density in said first ion chamber than in said second ion chamber to render the resistance characteristic of said first ion chamber to ion current flow therethrough relative to said second ion chamber substantially insensitive to the presence or absence of smoke aerosols and the like;

means for connecting said second ion chamber in communication with atmosphere to be monitored; and means for measuring changes in said ion current flow from said predetermined current level thereby to detect entry of smoke aerosols and the like into said second ion chamber.

* * * * *